US009562399B2

(12) United States Patent
Pollack

(10) Patent No.: US 9,562,399 B2
(45) Date of Patent: Feb. 7, 2017

(54) BUNDLED, ARTICULATED RISER SYSTEM FOR FPSO VESSEL

(71) Applicant: Seahorse Equipment Corp, Houston, TX (US)

(72) Inventor: Jack Pollack, Camarillo, CA (US)

(73) Assignee: Seahourse Equipment Corp., Houston, TX (US)

( * ) Notice: Subject to any disclaimer, the term of this patent is extended or adjusted under 35 U.S.C. 154(b) by 0 days.

(21) Appl. No.: 14/700,924

(22) Filed: Apr. 30, 2015

(65) Prior Publication Data

US 2015/0315853 A1 Nov. 5, 2015

Related U.S. Application Data

(60) Provisional application No. 61/986,229, filed on Apr. 30, 2014.

(51) Int. Cl.
*E21B 17/01* (2006.01)
*E21B 19/00* (2006.01)

(52) U.S. Cl.
CPC ..... *E21B 17/012* (2013.01); *E21B 17/01* (2013.01); *E21B 17/017* (2013.01); *E21B 19/004* (2013.01)

(58) Field of Classification Search
CPC ..... E21B 17/01; E21B 17/012; E21B 17/017; E21B 19/004
USPC ..... 405/223.1, 224.2, 224.4
See application file for complete search history.

(56) References Cited

U.S. PATENT DOCUMENTS 4,198,179 A * 4/1980 Pease ..... B63B 21/502 166/359
4,637,335 A 1/1987 Pollack
4,645,467 A 2/1987 Pollack
4,699,191 A 10/1987 Pollack et al.
4,708,178 A 11/1987 Pollack et al.
4,727,819 A 3/1988 Pollack
4,740,109 A * 4/1988 Horton ..... B63B 21/502 114/265
4,802,431 A 2/1989 Pollack
4,955,310 A 9/1990 Pollack
5,025,743 A 6/1991 Pollack
5,439,321 A * 8/1995 Hunter ..... B63B 21/502 166/350
5,755,607 A 5/1998 Boatman et al.
5,794,700 A 8/1998 Pollack
6,027,286 A * 2/2000 Pollack ..... B63B 21/50 166/354

(Continued)

FOREIGN PATENT DOCUMENTS

EP 0062125 A1 10/1982
FR WO 2007045783 A1 * 4/2007 ..... E21B 17/01

(Continued)

*Primary Examiner* — Frederick L Lagman
(74) *Attorney, Agent, or Firm* — Blank Rome LLP

(57) ABSTRACT

A method and apparatus for bundling flexible risers uses a vertically-hanging riser support shaft extending below the turret of a turret-moored FPSO to manage the motions of the risers. The risers may transition to a catenary configuration as they exit a bottom structure at the lower end of the riser support shaft and connect to wellheads or flowlines on the seafloor. Certain embodiments are suitable for use with a disconnectable buoyant turret mooring system while other embodiments may be used with spread-moored FPSOs.

10 Claims, 13 Drawing Sheets

(56) References Cited

U.S. PATENT DOCUMENTS 6,155,193 A 12/2000 Syvertsen et al.
6,210,075 B1 4/2001 Korloo
6,352,116 B1 * 3/2002 Børseth ..... E21B 19/004 166/359
6,422,791 B1 * 7/2002 Pallini, Jr. ..... E21B 17/017 166/355
6,461,083 B1 10/2002 Pionetti et al.
6,837,311 B1 * 1/2005 Sele ..... B23K 20/122 166/345
6,869,253 B2 * 3/2005 Biolley ..... E21B 17/015 166/345
7,287,935 B1 * 10/2007 Gehring ..... B63B 1/048 114/214
7,766,710 B2 8/2010 Braud et al.
8,905,142 B2 * 12/2014 Legras ..... E21B 17/1035 166/345
2002/0084077 A1 * 7/2002 Finn ..... B63B 21/50 166/354
2002/0115365 A1 * 8/2002 Nish ..... E21B 19/004 441/133
2003/0150618 A1 * 8/2003 Nish ..... E21B 17/012 166/350
2004/0028479 A1 * 2/2004 Horton, III ..... B63B 21/502 405/223.1
2004/0052586 A1 * 3/2004 Horton, III ..... B63B 21/502 405/223.1
2004/0079271 A1 * 4/2004 Charnock ..... E21B 19/24 114/293
2004/0182297 A1 * 9/2004 Wybro ..... E21B 19/004 114/230.1
2006/0177273 A1 * 8/2006 Bonnemaire ..... E21B 17/01 405/211
2010/0172699 A1 * 7/2010 Saint-Marcoux ... E21B 17/1035 405/224.2
2012/0318379 A1 * 12/2012 Benard ..... E21B 17/01 137/343
2013/0064606 A1 * 3/2013 Pionetti ..... B63B 21/50 405/166
2013/0299179 A1 11/2013 Joensen et al.
2014/0041878 A1 * 2/2014 Hatton ..... E21B 17/085 166/350

FOREIGN PATENT DOCUMENTS

GB 1473799 A * 5/1977 ..... E21B 7/128
GB 2065197 A * 6/1981 ..... E21B 17/017
GB 2504065 A 1/2014
WO WO 2004077951 A2 * 9/2004 ..... E21B 19/004
WO 2010097528 A1 9/2010

* cited by examiner

BUNDLED, ARTICULATED RISER SYSTEM FOR FPSO VESSEL

CROSS-REFERENCE TO RELATED APPLICATIONS

This application claims the benefit of U.S. Provisional Application No. 61/986,229 filed on Apr. 30, 2014.

STATEMENT REGARDING FEDERALLY SPONSORED RESEARCH OR DEVELOPMENT

Not Applicable

BACKGROUND OF THE INVENTION

1. Field of the Invention

The present invention generally relates to offshore vessels used for the production of petroleum products. More specifically, it relates to subsea risers used to connect a Floating Production, Storage and Offloading (FPSO) vessel to flow lines on the seafloor.

2. Description of the Related Art Including Information Disclosed Under 37 CFR 1.97 and 1.98

A Floating Production Storage and Offloading system (FPSO) is a floating facility installed above or close to an offshore oil and/or gas field to receive, process, store and export hydrocarbons.

It consists of a floater, which may be either a purpose-built vessel or a converted tanker, that is moored at a selected site. The cargo capacity of the vessel is used as buffer storage for the oil produced. The process facilities (topsides) and accommodations are installed on the floater. The mooring configuration may be of the spread mooring type or a single point mooring system, generally a turret.

The high pressure mixture of produced fluids is delivered to the process facilities mounted on the deck of the tanker, where the oil, gas and water are separated. The water is discharged overboard after treatment to eliminate hydrocarbons. The stabilized crude oil is stored in the cargo tanks and subsequently transferred into shuttle tankers either via a buoy or by laying side by side or in tandem to the FPSO.

The gas may be used for enhancing the liquid production through gas lift, and for energy production onboard the vessel. The remainder may be compressed and transported by pipeline to shore or reinjected into the reservoir.

Typically, offshore systems are designed to withstand the "100 year storm"—i.e. the most extreme storm that may statistically be expected to happen once every hundred years at the location where the system is installed. All locations have different hundred year storm conditions, with the worst storms being in the North Atlantic and the northern North Sea. Exceptionally bad storm conditions may occur in hurricane (typhoon) infested areas, but the storm path is relatively narrow (typically about 50 km). Thus, some FPSO mooring systems are designed to be disconnectable, so that the FPSO may temporarily move out of the storm path, and the mooring system need only be designed for moderate conditions.

There are three main types of mooring systems for FPSO vessels:

Spread Mooring wherein the FPSO is moored in a fixed position;

Single Point Mooring (SPM) Systems wherein the FPSO weathervanes around a fixed point; and, Dynamic Positioning (DP) systems which do not require anchor wires/chains or piled/seabed anchors. This system is the most accurate for station keeping but the most expensive to operate.

A Buoyant Turret Mooring (BTM) system is one type of disconnectable SPM that utilizes a mooring buoy fixed to the seabed by catenary anchor legs and supports crude oil and gas risers—steel or flexible pipes that transfer well fluids from the seabed to the surface. The BTM may be connected by means of a structural connector to the fixed turret. The fixed turret extends up through a moonpool in the tanker, supported on a weathervaning bearing and contains the reconnection winch, flow lines, control manifolds and fluid swivels located above the main deck. The weathervaning bearing allows the vessel to freely rotate about the mooring buoy, in accordance with the prevailing environmental conditions.

The BTM system was developed for areas where typhoon, hurricane or icebergs pose a danger to the FPSO and, primarily for safety reasons, rapid disconnection/reconnection is required. Disconnection and reconnection operations may be carried out from the tanker without external intervention. When disconnected, the mooring buoy sinks to neutral buoyancy under water and the FPSO may sail away.

Another type of FPSO is the Floating Production, Storage and Offloading system for Liquefied Natural Gas (LNG FPSO), a floating facility installed above or close to an offshore gas field in order to receive, process, liquefy, store and export natural gas. It typically consists of a purpose-built floater containing LNG storage tanks with process facilities, gas treatment, liquefaction train(s) and an accommodation block on the deck. The LNG FPSO may be permanently moored to the seabed by a turret-type mooring system.

The high-pressure well stream fluid is delivered from the seabed, via flexible hoses and the swivel, to process facilities on the deck of the LNG FPSO. The process facility, located on the deck, separates the fluid in gas, condensate and water. The water is treated to eliminate any remaining hydrocarbons and discharged overboard. The condensate is treated and stored in separate crude oil tanks.

The gas is separated in methane for LNG production and propane and butane for treatment into LPG. Methane is then treated and liquefied in one or more of the LNG trains which are also located on the deck. The LNG is finally stored at minus 162° C. in the special LNG cargo tanks. On a regular basis the LNG may be transferred from the LNG cargo tanks to LNG shuttle tankers via side-by-side or tandem offloading.

LNG production is by far the largest product on an LNG FPSO, however the FPSO also produces condensate and LPG, which are stored in special LPG and condensate tanks and are offloaded separately via their specific offloading system.

Liquefied Petroleum Gas (LPG) is predominately butane and propane, separated from well fluid stream. LPG may be transported under pressure or in refrigerated vessels (LPG carriers).

A Steel Catenary Riser is a steel pipe hung in a catenary configuration from a floating vessel in deep water to transmit flow to or from the seafloor.

A Single Point Mooring (SPM) is a mooring system that enables the vessel to weathervane whilst it loads or unloads hydrocarbons, chemicals or fresh water. The two categories of SPMs are:

a single point mooring buoy or tower that is designed for use by any trading tanker, and is thus independent of the vessel;

a system, such as a turret mooring, that is incorporated within a vessel such as an FPSO.

A swivel is a mechanical component consisting of a fixed and a rotating part, connected by means of a roller bearing and a sealing arrangement, allowing fluids to pass between the stationary and the weathervaning part of a Single Point Mooring system.

A swivel stack is an arrangement of several individual swivels stacked on top of each other to allow the continuous transfer on a weathervaning FPSO of fluids, gases, controls and power between the risers and the process facilities on the FPSO deck.

The turret system may be integrated into or attached to the hull of the tanker, in most cases near the bow, and allows the tanker to weathervane around it and thereby take up the line of least resistance to the combined forces of wind, waves and current. A high pressure oil and gas swivel stack is mounted onto the mooring system. This swivel stack is the connection between the risers from the subsea flowlines on the seabed to the piping onboard the vessel. It allows the flow of oil, gas and water onto the unit to continue without interruption while the FPSO weathervanes. For reasons of size and cost, the number of swivels is kept to a minimum, and therefore the flow of oil and gas has to be manifolded in the turret area, particularly when the system produces from a large number of wells.

The turret mooring and high pressure swivel stack are thus the essential components of an FPSO.

U.S. Pat. No. 6,155,193 to Syvertsen et al. describes a vessel for use in the production and/or storage of hydrocarbons, including a receiving device having a downwardly open space for receiving and releasably securing a submerged buoy connected to at least one riser, a rotatable connector for connection with the buoy and transfer of fluids, and a dynamic positioning system for keeping the vessel at a desired position. The vessel includes a moonpool extending through the hull, and the receiving device is a unit which is arranged in the moonpool for raising and lowering, the rotatable connector being arranged at deck level, for connection to the buoy when the receiving unit with the buoy has been raised to an upper position in the moonpool.

U.S. Pub. No. 2013/0299179 describes a riser configuration having a rigid riser portion and a flexible riser portion. The riser configuration also includes a subsea buoy across which the riser portions are connected. Buoyancy means are mounted on the flexible riser portion.

GB2504065 (A) describes a subsea flexible riser used for conveying fluids, such as hydrocarbons. The riser comprises an internal fluid-tight liner, a load-bearing structural layer arranged to withstand internal and external pressure, at least one external load bearing structural layer and an outer protective layer. The internal load bearing structural layer and the internal liner comprise fusible polymer matrix materials and the internal load bearing structural layer is bonded to the internal liner. The internal load-bearing structural layer comprises a fiber reinforced composite material. At least one external load-bearing structural layer is a tensile armor comprising wound metal wires. A method of manufacturing a subsea flexible riser by extrusion is also described.

U.S. Pat. No. 7,766,710 discloses a mooring system that includes a vessel with a lower-side cavity, a turret extending from deck level to the cavity, and a coupling mechanism releasably attaching a mooring buoy to the cavity, at least one buoy-supported riser. The riser end has a coupling member, the riser being slidable via a buoy opening, a riser connector member being attached to a movable transport member upwardly displaceable by a drive element, for when the buoy and vessel are coupled, attaching the riser connector member to the transport member transporting the transport member upward while sliding the riser through the buoy and attaching the coupling member to a vessel transfer duct, and for lowering the riser while sliding the riser through the buoy until the connector member is supported by the buoy, prior to coupling member release, and release of the riser connector member from the transport member, followed by buoy lowering.

U.S. Pat. No. 5,755,607 describes a mooring system for a vessel having a mooring turret which is rotatably coupled to a well of the vessel such that the vessel is free to weathervane about the mooring turret. An anchor leg support base is fixed with the mooring turret with anchor lines secured thereto and anchored to the seafloor. A riser turret is rotatably coupled to the mooring turret and is fixed to the well of the vessel. A riser support base is pivotally coupled to a riser support device for mounting the upper ends of a plurality of flexible risers extending from the seafloor. The riser mounting device is arranged and designed to pivot about two axes at right angles to each other relative to the riser support base. The gimbaled riser mounting device provides a generally uniform load distribution among the risers upon twisting or bundling of the risers which results from weathervaning of the vessel about the mooring turret.

U.S. Pat. Nos. 4,637,335, 4,727,819, 4,802,431, and 5,025,743 disclose a mooring system which can be rapidly installed. The system includes a transfer structure attached to a vessel, an anchor line extending from the transfer structure to a chain table near the seafloor, and catenary chains extending from the chain table to the seafloor. A weight hangs from the chain table to help in setting up the system and in mooring a vessel thereafter. The transfer structure includes a platform that can rotate with respect to the vessel, and a direction sensor for controlling a motor that rotates the platform opposite to rotation of the vessel, to avoid twist of the anchor line.

U.S. Pat. Nos. 4,699,191 and 4,708,178 disclose an improved hose structure for passing fluid across a universal joint, that permits a transfer structure to pivot about two horizontal axes with respect to a vessel or the like at the sea surface. A hose or other flexible conduit has a lower end connected to a pipe on the transfer structure and an upper end connected to a pipe on the vessel which can move up and down and which is biased upwardly. When the transfer structure tilts, to raise or lower the lower end of the hose, the upper end can also rise or fall to minimize bending of the hose, so that a substantially straight hose can be used.

U.S. Pat. No. 4,645,467 discloses an improved offshore terminal of the type that includes a riser loosely anchored at the seafloor so its upper end can extend from a deep underwater level up to the surface to moor a tanker and transfer hydrocarbons to it. A weight hangs from the lower end of the column to improve dynamic mooring and, when the riser is disconnected, to limit the sink depth of the riser. For movement to the deployed position, the riser is lifted by extending a line downwardly from a winch on the vessel, through a central hole in the connector frame down to the top of the riser, the line being pulled to raise the riser until its upper end lies within the central hole of the connector frame. A perforated upper portion of the riser is then in fluid communication with the inner portion of a fluid swivel, so that hydrocarbons can pass out of a conduit within the riser and into the swivel.

EP 0062125 describes a self-standing marine riser which comprises a base, a riser column, a flexible joint between the base and the riser column, and means for providing a loose coupling between the top of the riser column and a vessel, rig or platform on the surface above the location of the riser. The riser column comprises an upper column section which includes at least one buoyancy chamber, and a lower, relatively slender column section The riser includes, or is adapted to support, at least one conduit for the conveyance of a fluid (e.g. oil or gas) or a control line. The buoyancy provided by the upper section of the riser column is preferably variable, and this facilitates the connection and use of the riser. The riser may be used for drilling operations or for production operations. It is said that when employing such a riser, it is not necessary to use large riser tensions in order to maintain the position and structural integrity of the riser in deep water and rough weather.

BRIEF SUMMARY OF THE INVENTION

A bundled, articulated riser system according to the invention is designed to create a more compact riser system that can be used between the seafloor and an FPSO. The system is based on the use of a bundled riser approach that is attached to the FPSO by way of gimbals or a universal joint. This connection may be to a weathervaning, turret-moored FPSO as shown in FIG. 1, or directly to a spread-moored FPSO vessel as shown in FIG. 5. From the vessel, a riser bundle according to the invention may traverse most of the water column to a location as close as practical to the seafloor where it may be partly restrained from horizontal motion. A variety of connections from the top of the riser bundle to the turret or vessel and bottom of the riser bundle to the seafloor are described.

BRIEF DESCRIPTION OF THE SEVERAL VIEWS OF THE DRAWING(S)

FIG. 7 schematically illustrates several examples of riser guide template sleeves according to the invention.

DETAILED DESCRIPTION OF THE INVENTION

Ship-shaped FPSOs are used to produce subsea reservoirs. To enable this production a variety of risers are used to transfer flow of fluids and energy between the FPSO vessel and the seafloor. In deep water, these riser systems become increasingly complex due to the longer distance, environment, temperatures, and pressures required to be overcome by the risers. Typically many of these flow paths are handled by individual risers so, as the number of paths increases, the congestion created by these risers starts to be problematic as currents may cause large riser excursions that may cause risers to clash. This is aggravated by the use of differing riser diameters with various unit weights, as different riser diameters and weights respond differently to currents.

One efficient approach to high pressure deepwater risers is the use of individual steel risers or Steel Catenary Risers (SCRs), which can handle the large internal and external pressures, aggressively corrosive fluids and temperatures that may be found with deepwater reservoirs. These SCRs however take up a lot of room as they move down the water column and, if not in relatively benign wave environments, FPSO heave motion causes fatigue issues where they come into contact with the seafloor. The fatigue issues may be improved for moderately harsh environments by adding some buoyancy to these SCRs forming a lazy Wave (LW) near the seafloor creating a slight arch that minimizes the seafloor touch down problem. This buoyancy, however, also increases the length and motions of these LWSCRs and also increases their hardware and installation costs.

An alternative design used for deepwater risers is the use of a hybrid riser system using riser towers. These towers may use either a single or bundle of steel vertical riser(s) from the seafloor to a subsea buoy that supports these vertical steel riser(s) to a depth of perhaps 200 meters from the sea surface. The bundled systems also use some distributed buoyancy along the length of the vertical pipes coming up from the seafloor. From the approximately 200-meter water depth, a flexible pipe connection is made to the FPSO vessel turret if it is a weathervaning FPSO or to some other location (typically near midship) if a spread moored FPSO. The use of these flexible lines at the top provides the flexibility for the risers to handle the various motions of the FPSO. These tower systems may be used in the harshest of environments but they result in very expensive hardware and installation costs. The use of the flexible riser also creates some limitations when used at higher temperatures or with certain aggressive, corrosive fluids that may be found in these reservoirs.

Figure 1:
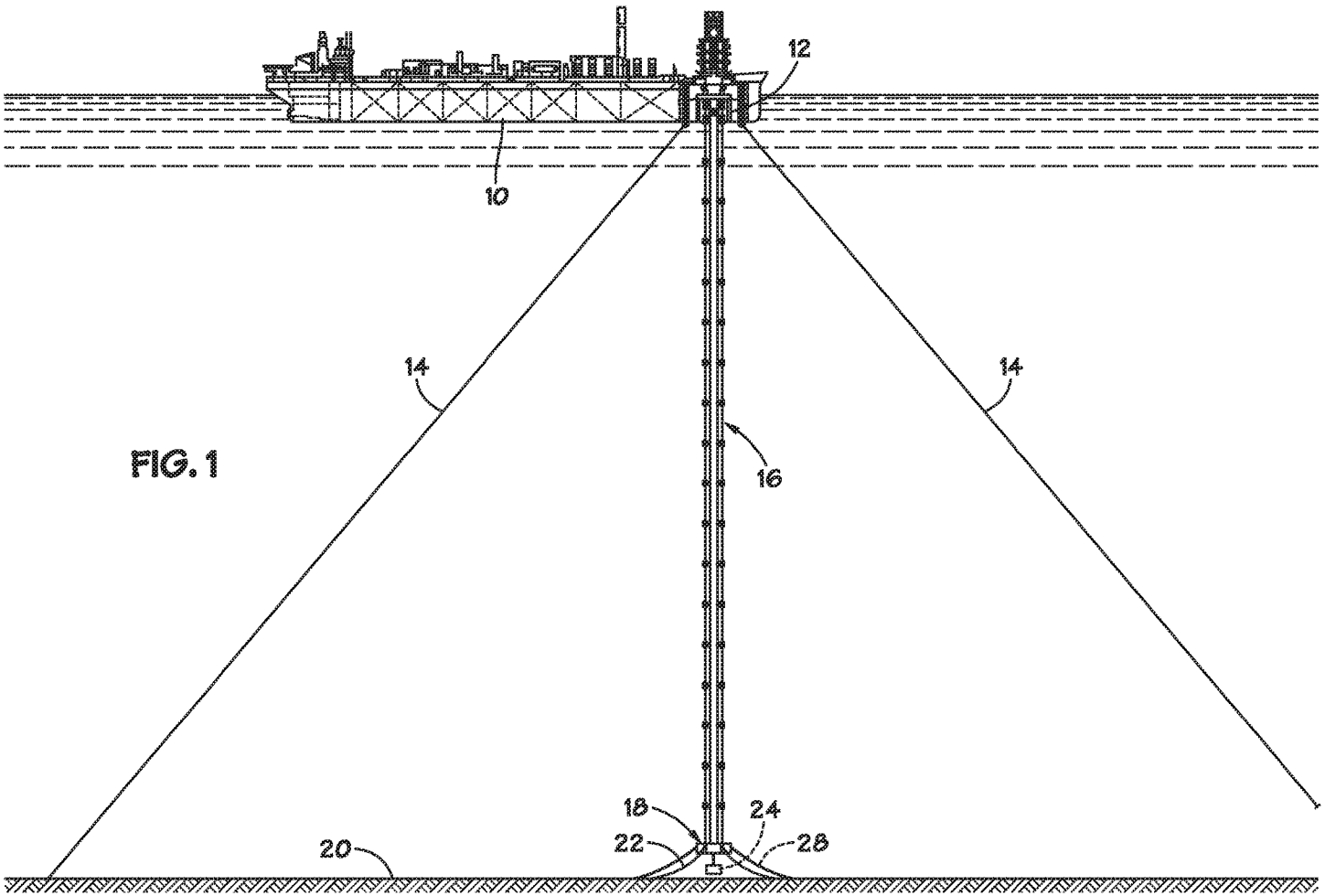
FIG. 1 is a schematic of a basic bundled flexible riser configuration for a turret moored FPSO system according to a first embodiment of the invention.

This invention provides a more compact riser system that may be used between the seafloor and an FPSO. The system is based on the use of a bundled riser approach that may be attached to the FPSO by way of gimbals. This connection may be to a weathervaning, turret-moored FPSO as shown in FIG. 1, or directly to a spread-moored FPSO. From the vessel, this riser bundle may traverse most of the water column to a location as close as practical to the seafloor where it may be partially restrained from horizontal motion. A variety of connections from the top of the riser bundle to the turret or vessel and bottom of the riser bundle to the seafloor are described.

Figure 2:
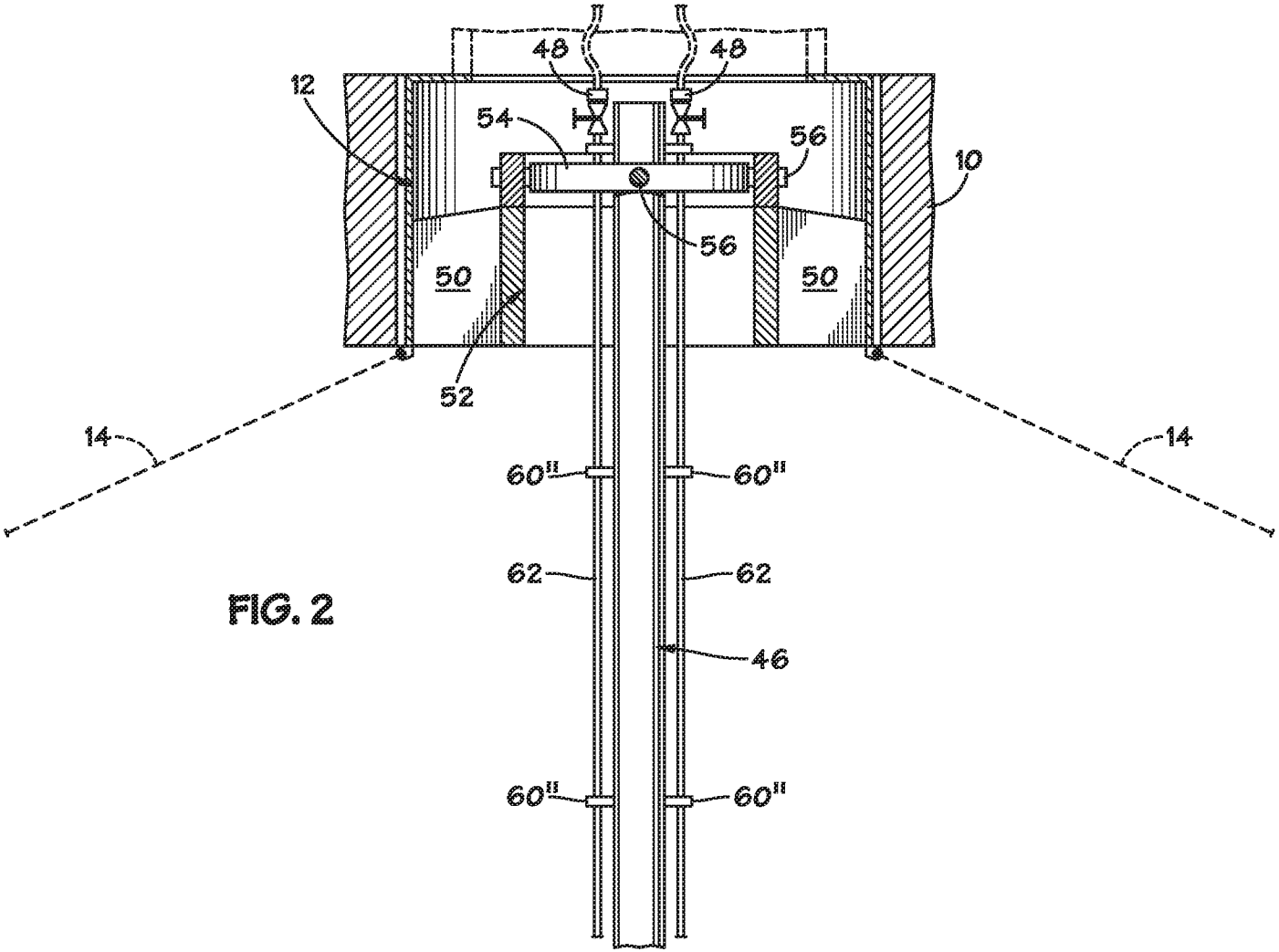
FIG. 2 is a schematic cross-sectional view of a gimbaled connection of a bundled flexible riser to an FPSO vessel turret.

The top of the riser bundle may be supported by gimbals in the FPSO turret as shown in FIG. 2. For a spread moored system (not shown), the gimbals may be supported directly to the vessel in a moon pool. The riser structure and riser bundle pass through the FPSO-located gimbal ring, which supports the riser bundle via orthogonal pins passing to the riser and turret. To minimize the motion of the riser top when the vessel rolls, pitches or yaws this gimbal may optimally be placed as close as possible to the vessel CG (possible if spread moored or dynamically positioned) or at least on its horizontal longitudinal axis (if using a passive weathervaning turret). To deal with the relative angular roll and pitch motions between the turret and riser bundle, flexible piping must be used in order to have a continuous flow from the riser to the vessel. To minimize this relative motion, it may be best to keep the individual riser termination as close as possible to the gimbal's center of rotation. The location of the riser terminations may preferably be placed within the turret at a level normally above the water line; however all of the components at these terminations may also be submerged.

A variety of flexible connections are possible for the flowlines from the articulating riser top to the turret or vessel. To minimize these flexible connections, common riser flow lines may be manifolded at the top above the riser terminations. Spool pieces may also be used to bring the riser piping closer to the bundle center to minimize relative motions between the riser and vessel flowlines. The flexible connection within the turret may be made with a suitable flexible flowline if it is capable of handling the expected pressures, temperatures and flow chemistries. These flexible lines may be arranged in configurations allowing all potential angles between vessel and riser top. Configurations of this type have been used on riser turret mooring (RTM) systems. Should there be a problem with using a flexible line, alternatives exist, for example: a) the use of steel pipe lengths having a series of six swivels, b) steel pipe length with a series of three flex-joints, c) or the use of newly developed composite pipes that have flexibilities approaching those of flexible pipes. All of these alternatives have temperature limitations. The highest temperature alternative being a), followed by b), then c). It should be noted that these temperature limitations exist not only with the method of the present invention, but in the riser systems of the prior art.

The makeup and construction of the riser bundle may be performed sequentially until the bundle reaches its proper length. Once at full length, other flowlines may be added until the bundle is completed. The system may then be transferred to the FPSO by keel hauling it into place. Consideration may be given to installing this type of makeup equipment on the FPSO. A spread-moored vessel may easily be fitted with a drilling type derrick whereas a turret moored FPSO may need to clear a central shaft within the upper turret in which to house such equipment. The fluid swivel, as usual, may be placed at the top of the turret above the shaft. Having this equipment on board the FPSO may allow self-installation of the riser bundle and allow for a phased, planned, riser installation over the life of the field. Generally, however, the riser may consist of a central structural pipe with a series of template guides holding flowlines in the bundle at certain spacing. For installation purposes, one may consider a dry horizontal makeup, tow and upending, however it lends itself better to a vertical makeup from a drilling type platform or workover type vessel where a series of connected pipes may be installed.

The bottom of the riser bundle may be designed to help control the linear and angular motions that may have to be accommodated by the flowline passing from the bundle to the seafloor. The bundle bottom may consist of a prefabricated section having a structural connection to the upper bundle, flowline connections to the bundle flowlines, internal flowpaths to connectors for the connection to the piping passing to the seafloor, and other connections for chains and installation aids as required. To minimize the horizontal excursion of the bundled riser bottom it may be partially restrained from horizontal motion. This horizontal restraint may depend on the type of flexible flowline connection used between the riser bottom and seafloor. Should the flowlines have a low horizontal stiffness, a horizontal restraint system comprised of three groups of catenary chains shown in FIG. 1A or synthetic lines may be attached to the bottom of the riser bundle. The use of chains adds weight and accommodates any vertical motion while keeping the horizontal excursion within a desired envelope of, for instance, 10 meters. The use of synthetic lines may not add weight but may be able to allow for the same type of motion control. To control angular motion, additional weight may be added to the bottom of the bundle. This weight may be integral or added in the form of a hanging clump weight. The tension created by this additional weight acts to minimize the riser bundle curvature due to current.

The bottom of the riser bundle must connect the riser bundle flowlines to the flowlines passing to the seafloor. There are a variety of threaded mechanical connectors that may be used to terminate the riser bundle flowlines to the riser bottom and these may be made up during the original bundle installation or as further lines are added to the bundle. The connection of the flowlines from bundle to seafloor may be made up after bundle installation and therefore use underwater mateable connectors. Generally these connectors may be made up hydraulically with the help of an ROV. These connections may use proven vertical stab-type connectors, which have had the mating part pre-installed on the prefabricated riser bundle bottom section.

There are several different flowline configurations possible for connecting the riser bundle bottom to the seafloor. Generally, the seafloor connection may be located on a Pipe Line End Termination (PLET) in the vicinity of the riser bottom. There should be a sufficient horizontal distance between the PLET and riser bottom to enable the flexibility of the system components not to be overstressed. The configurations that may be used are:

1. FIG. 1C shows one option having two articulated pipes. One pipe is a generally horizontal steel pipe having a flex•joint at the riser bundle bottom connector. This pipe extends horizontally to a down facing elbow with an overhead subsea buoy. Below the elbow is a flex•joint with a generally vertical down pipe with termination to another flex•joint on top of a vertical stab connector. The vertical down pipe length may be dependent on the height and horizontal excursion of the riser bundle connector with respect to the seafloor. The installed pipe geometry should be such that keeps the flex-joint angles below 20 degrees and preferably below 15 degrees. The pipe system may installed by lowering it with an installation line to the riser connector (in certain embodiments supported from the FPSO) and a second line to the buoy above the vertical down pipe and connector. The buoy may be designed for the proper amount of operational lift by adding weight to the connector at the bottom of the vertical down pipe. During lowering, the overall piping system may be negatively buoyant. When stabbed in on the riser bundle bottom and on the PLET, sufficient weight is transferred onto the connections so the buoy has the proper buoyancy for supporting the piping system. Should the horizontal pipe section be too long to be self•supporting then strengthening and distributed buoyancy may be applied to make it so.

2. A similar system of two pipes as described above may be used with stress joints being substituted for the flex-joints. Should bottom angular excursions be excessive for the piping torsion, then in•line swivels may be added to the pipes. The overall maximum angles of the stress joints should be less than 15 degrees or preferably below 10 degrees.

3. A similar system of two pipes with a series of six swivels arranged to take all pipe excursions may be added to the piping. The maximum angles at any of the swivels should be kept below 30 degrees.

4. Flexible piping if suitable for the pressure, temperature and flow product chemistry may be used in a catenary or arched buoyant configuration.

5. An SCR with a buoyant lazy wave to seafloor piping is shown in FIG. 1D. An alternative use of a buoyant arch to a vertical PLET connection may also be possible but is not shown. Owing to the lack of flexibility, the horizontal extent of these arches may have to be several hundred meters from the riser bundle.

6. A composite pipe (if suitable for the temperatures encountered) may be used in an arched configuration and is shown in FIG. 1E. This arch is considerably smaller than what may be required for an SCR arch owing to the much greater flexibility of this composite pipe. Weights or buoyancy may be added to confine the composite pipe to do its primary bending over certain lengths.

7. A combination of the above.

Figure 4A:
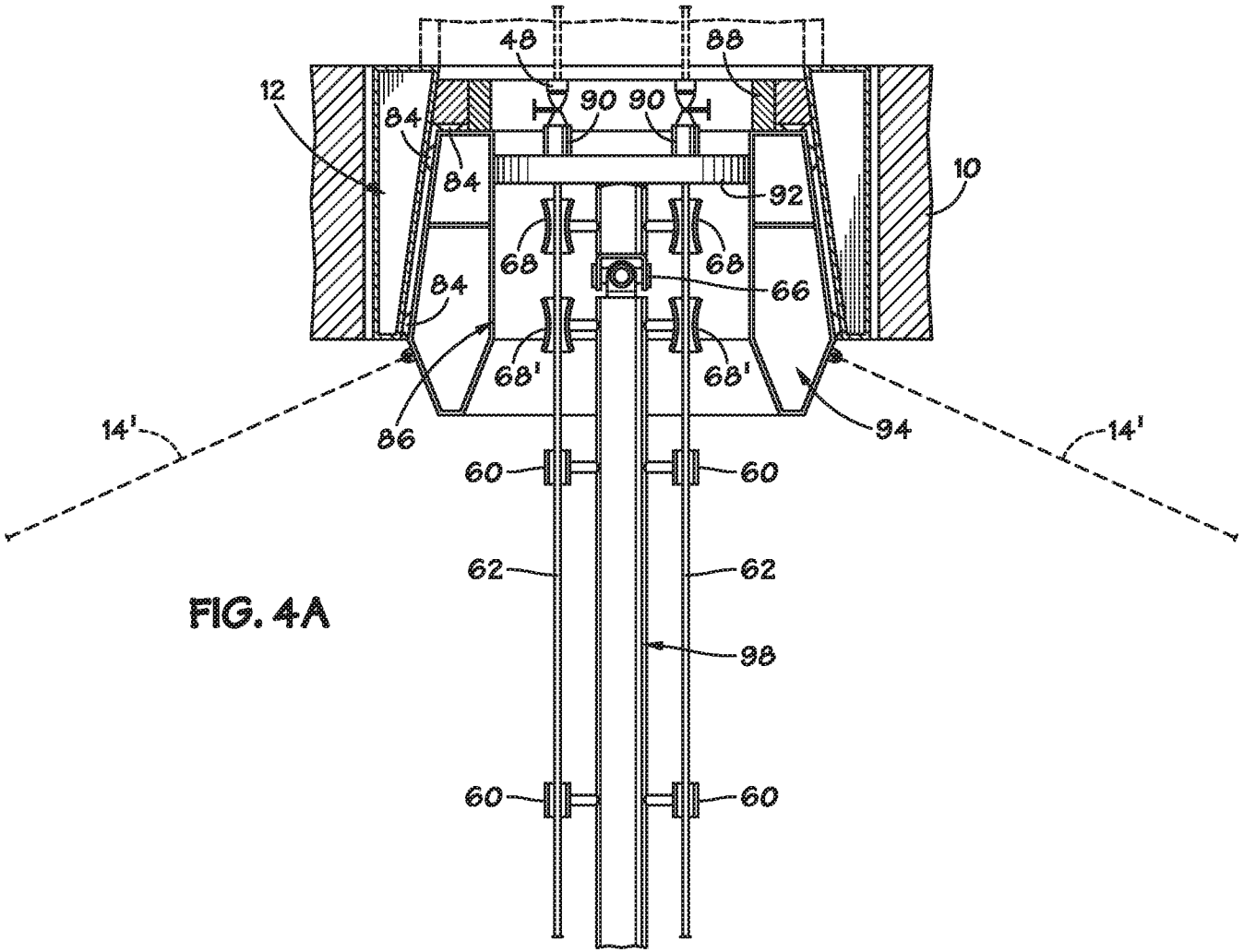
FIG. 4A is a schematic cross-sectional view of the upper portion of a disconnectable bundled riser system according to an embodiment of the invention.

This type of riser system may also be used with disconnectable FPSO systems. FIG. 4A shows the general configuration of a turret-disconnectable buoy with a BARS riser system. The basic configuration of the BARS system may remain the same. Some required changes may be the addition of buoyancy in the riser bundle to make it somewhat more buoyant. There may be a large hanging clump weight below the riser for disconnect and to limit the disconnect set down. This clump weight may also be used to minimize riser current curvature in the connected mode. There may be additional vertical motion of the system due to disconnect, however the use of the clump weight may limit this motion at the bottom of the riser. The additional vertical set down may be accommodated by the lower flexible seafloor piping.

In very deep water of 1500 meters or more, it is often desirable to use steel catenary risers SCRs as they have less corrosion and structural problems than steel un-bonded flexible pipes (SUFP). The SCRs also have the advantage of being lighter and cheaper than the SUFP. With the advances in technology of creating composites, one may now create flexible un-bonded risers where the steel is replaced with various glass, carbon or other composite reinforcement materials. This results in composite un-bonded flexible pipe (CUFP) that is much lighter in water than those using steel. The cost of these composite risers is still more than SCRs, however their weight, fatigue and corrosion advantages make them attractive for deep water use.

Whenever a new technology is available for use it is desired to make the most efficient use of it. These composite un-bonded risers have seen very little use in deep water particularly where a large number of them may be used from an FPSO.

The weight advantage offered by these CUFP risers is a great benefit as it requires less buoyancy to support the risers from the FPSO, thus saving on vessel displacement. This weight advantage is somewhat eroded by the fact that the reduction in riser tension from self-weight makes the riser more susceptible to drift and vortex-induced vibrations (VIV) in currents. To counter this low weight, there may be steel armoring introduced into the composite flexible pipe making a hybrid unbonded flexible pipe (HUFP) which is heavier in water. This weight increase, while perhaps necessary, is counterproductive and an efficient configuration should have the means for taking full advantage of the weight savings by addressing the reduction of drift and VIV.

The means for controlling drift and VIV is to interconnect or bundle the risers and have them hang vertically down the water column. In this manner the riser lengths are minimized, prevented from clashing and may have a small, well defined touchdown area. This minimizes bottom congestion and allows the risers to be laid radially outward to their subsea tie-ins. The possible configurations that may be used to create this type of bundled riser approach for permanent or disconnectable turret type FPSOs and also spread moored FPSOs are shown in the accompanying figures.

In FIG. 1, a permanently moored turret FPSO is shown with a bundled riser connected from the turret to a riser bundle bottom structure. The turret is conventionally moored by radial mooring legs, which fix the turret from rotation while a bearing system allows the FPSO to weathervane. From the turret, the risers all run vertically downward to the bottom structure 18 from where they catenary to the seafloor. Having these risers in short catenaries may help to limit their touch-down zone fatigue. The composite risers having better fatigue resistance than steel flexible risers should preclude any problems with touch down fatigue, however should fatigue still be a problem, some buoyancy or weight may be added to the near-bottom riser.

FIG. 1 also shows the possible attachment of optional riser bundle restraint mooring lines and/or a clump weight to the riser bundle bottom structure. The function of the restraint lines may be to minimize the horizontal motion of the bundle in the event this motion is deemed excessive for the riser touchdown. The restraint lines may also be necessary to stabilize the bottom motion during the initial and later stages of riser installation. The function of the clump weight is to provide sufficient tension in the bundle to control its curvature and to limit its pendulum motion if unrestrained by mooring lines. Depending on installation, the clump weight may be eliminated by inclusion of weight in the bottom structure.

Figure 2A:
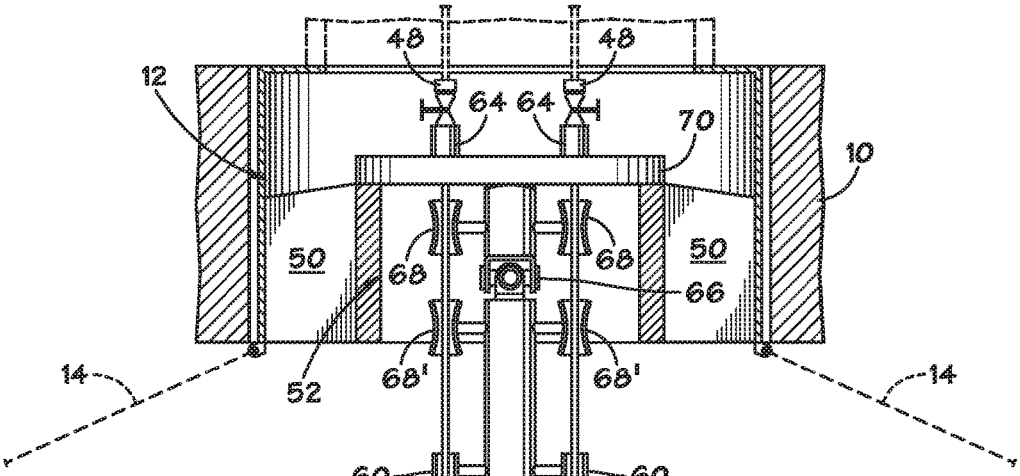
FIG. 2A is a schematic cross-sectional view of another embodiment of a connection of a bundled flexible riser according to the invention to an FPSO vessel turret.

A close up of the upper riser bundle connection to the turret is shown in FIG. 2A. For simplicity, only two risers are shown. However, there may be as many risers (and umbilicals) as required fixed radially within the bundle. The risers are supported in the turret on the riser support deck from where they hang vertically down along the riser bundle. Below the riser support deck, a U-joint may be used to attach the riser bundle support shaft to the turret. The support shaft function is primarily to support riser guides and the non-riser tension in the vertical bundle. The riser guide vertical placement is designed to keep the risers from clashing and to help control VIV. The horizontal spacing of the risers within the templates may also be designed to prevent clashing and VIV. This bundle design may be similar to that used for the GAP which had a long horizontal underwater bundle.

Operationally, the riser bundle shaft loading is normally quite low. During heavy seas the bundle may, however, articulate and bend. The design of this shaft may consider using a small diameter pipe (possibly a cable) that may flex and stay within allowable stresses. The weight attached to the bottom of the riser bundle shaft may also be designed to minimize this bending, as a larger weight may reduce the curvature. If shaft stresses are still too high, additional U-joints may be incorporated further down the shaft to relieve bending.

When the riser bundle shaft articulates within the turret, it may cause the risers to bend. This bending may be controlled by having trumpet guides fixed directly above and below the U-joint. These guides may have curvatures that keep the riser bending well above their minimum dynamic bending radius. When articulating about the U-joint, the risers may move up or down within the guide below the U-joint and along the complete riser bundle. This sliding may promote some damage in the carcass of the riser. A variety of methods are available to prevent this damage and these may be used as appropriate for the design. Some preventative methods include use of low-friction, nonabrasive coatings on the guides and/or pipe, small rollers within the guides, allowing the lower U-joint guide to articulate relative to the bundle shaft avoiding any sliding, etc.

Figure 3:
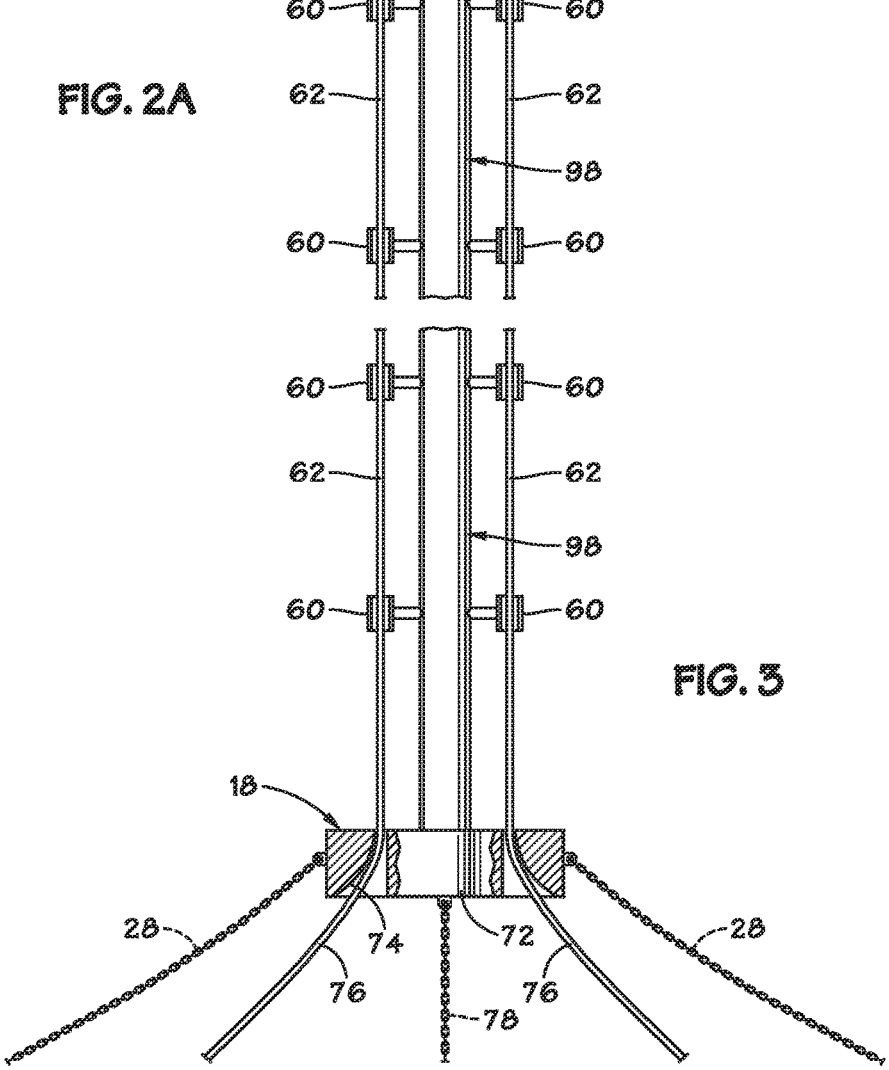
FIG. 3 is a schematic side view of the lower end of a bundled riser for a turret moored system according to one embodiment of the invention.

The bottom termination of the riser bundle is shown in FIG. 3. The distance from the bundle to the seafloor may be designed to be as close as practical. This distance may be site specific and likely differ to account for design and installation parameters. This Figure shows the risers traverse vertically downward into the riser bundle bottom structure where they then bend outward around a guide that keeps the riser curvature above its minimum dynamic bend radius. To prevent chafing of the riser when moving in relation to the guide, a series of roller or other anti-chafing means may be used to line the guide. FIG. 3 shows the riser bundle bottom structure with attachments for optional mooring restraint lines, compartment for ballast weight and/or a clump weight line. All of these options may be used to minimize the excursion and bending of the riser bundle and may be used, if found necessary or desirable.

In areas of severe storms or ice, FPSOs are sometimes forced to disconnect. FIG. 1B shows how a bundle system may be used in such an environment when used with a BTM. To minimize the required buoyancy of the disconnected buoy, the mooring system may be changed to incorporate spring buoys, as these buoys help to support the mooring load. A clump weight may be used to reliably locate the vertical position of the disconnected system. This clump weight acts like a gravity anchor that pulls the disconnected system down a designed distance when disconnecting. Also, to limit the horizontal excursion in both the connected and disconnected condition, mooring restraint lines may be attached to the bottom structure.

The details of the disconnect buoy and bundled riser top connection are shown in FIG. 4A. The riser bundle is terminated to a perforated riser termination deck in the buoy that may be housed in the turret when connected. The termination deck may be perforated to allow for the easy flow through of water when the buoy is in the connect or disconnect mode. The BTM is essentially a donut buoy with a connector and all the mating interfaces to the turret. The details of the bundle and riser connection and interfaces with the buoy are the same as those for the permanent turret system. One difference in the permanent to disconnectable riser bundle is that the riser bundle support shaft for the disconnectable buoy is designed to supply buoyancy to the disconnected system. This is done to limit the displacement of the BTM to a size that is easy to disconnect and reconnect. Spreading the required buoyancy for the disconnected system over a length of the bundle support shaft minimizes the vertical added mass of the combined system, making it easier to move vertically, which reduces reconnection winching requirements and snatch loads in the reconnection line.

Figure 4B:
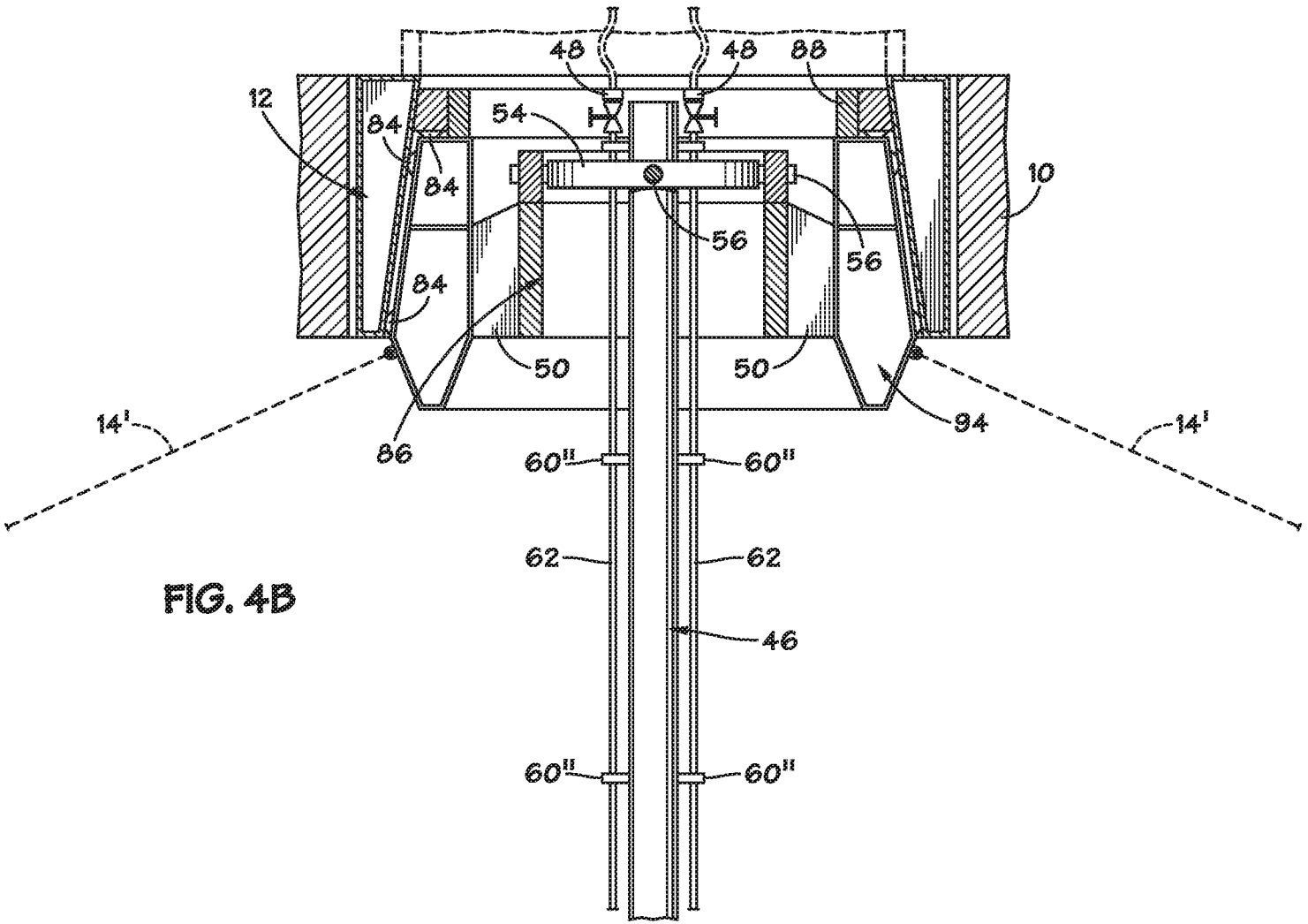
FIG. 4B is a schematic cross-sectional view of the upper portion of a disconnectable bundled riser system according to gimbaled embodiment of the invention.

FIG. 4B illustrates an alternative embodiment of a disconnectable BTM with a bundled articulated riser system according to another embodiment of the invention. In this embodiment, riser bundle support shaft and buoy 98 is articulated to turret buoy central shaft 86 by means of gimbal ring 54.

Figure 5B:
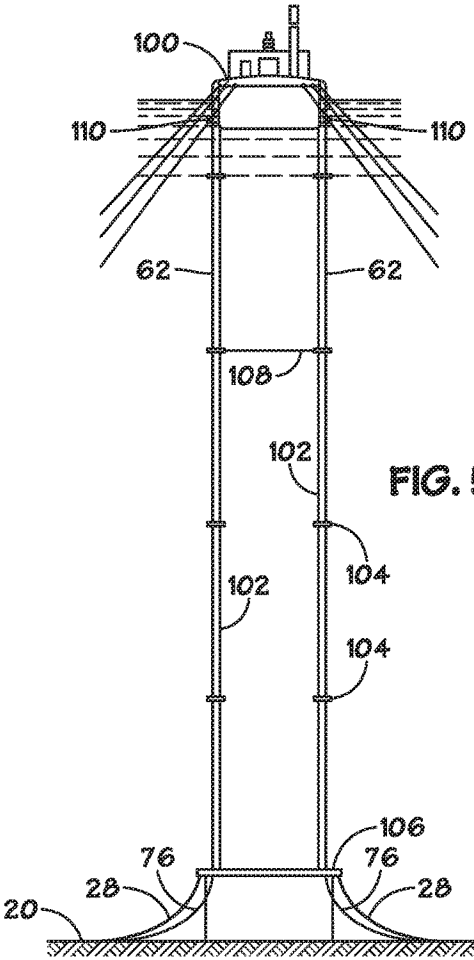
FIG. 5 shows schematic side and end views of a riser system according to an embodiment of the invention for a spread-moored FPSO vessel.
Figure 5A:
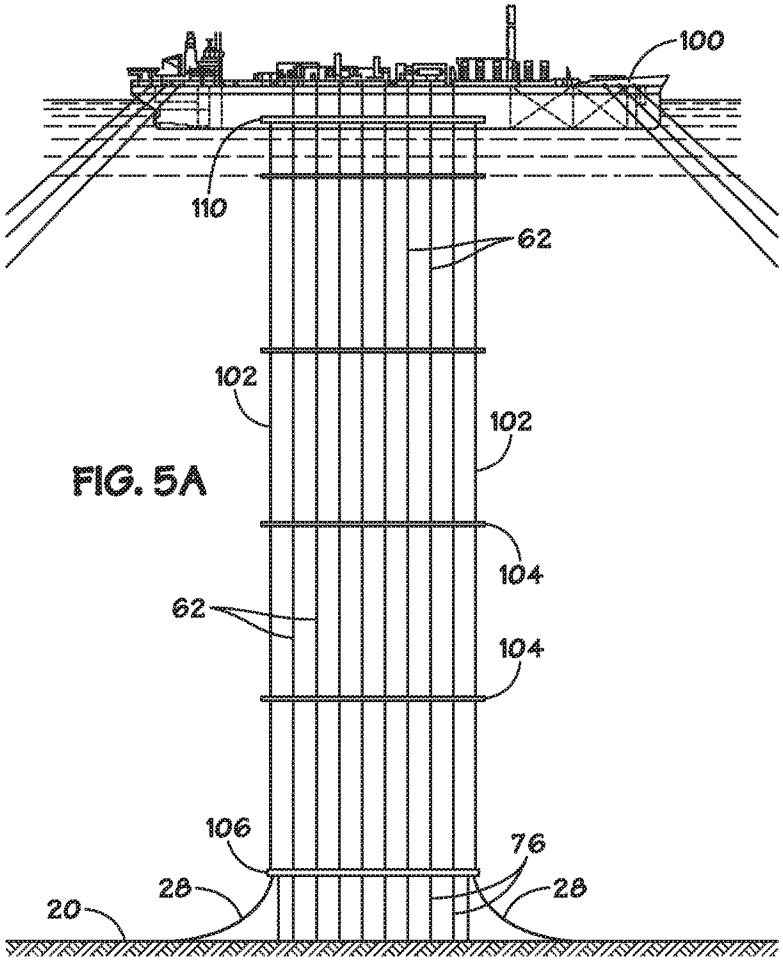

The bundled riser approach for a spread-moored FPSO is shown in FIG. 5. The normal riser configurations for spread moors are located on one or both sides of the FPSO as close as possible to the mid-ship. They may also be located in a moonpool, which may be easy to accommodate with similar riser bundle shafts, as described previously. However, a more preferred location may be over the sides as shown in FIG. 5. The risers here may again be arranged to pass vertically downward to a weighted bottom template structure that may be horizontally restrained with mooring lines. FIG. 5 shows a large bottom template. However, this may be split into separate templates for both sides of the FPSO as this may be easier to install. These separate bottom templates may also be cross connected after they are in place. If risers are only used on one side, then a single template may be used at the bottom. The bottom template(s) may be held by tendons that may terminate near the FPSO keel. The tendons may be made from chain, cable or, pipe with attachment points for the bottom and intermediate templates. The risers may be attached outside the vessel deck from where they pass vertically through keel-located trumpet guide(s) and through a series of (as required) intermediate templates until they pass through a curved guide of the bottom template and continue to the seafloor in a catenary. With the tendon connection being at the keel in line with the riser keel guides, there may be very little relative vertical motion between the templates and risers, and thus chafing of the risers at these contact points may be minimal.

Currently, flowline risers from FPSOs are generally attached to separate FPSO turret attachment points and move radially away from the vessel in separate directions or with sufficient clearance to the sea bottom or to submerged support systems not connected to the FPSO. This type of support requires a long riser because, when moving downward, it also moves a considerable distance horizontally. The method and apparatus disclosed herein effectively minimizes the riser length as it travels down to the seabed as it covers the maximum length vertically and only has a small vertical portion where the riser moves radially and bends to lie on the sea bed. The riser lengths in all of the bundled risers are thus minimized and the risers are also held by a guide system so that they do not interfere. This interference may be a significant problem for multiple, individual lightweight risers as they may easily drift in currents and drag on the seafloor. This is avoided by having the riser bundle weighted and otherwise restrained to the seafloor. This system therefore effectively takes advantage of the new lightweight composite type risers by controlling their descent and seafloor landing area.

The invention may best be understood by reference to the exemplary embodiment(s) illustrated in the drawing figures wherein the following reference numbers are used:

10 turret-moored FPSO
12 turret
14 mooring lines
14' spring buoy mooring lines
16 riser bundle
18 riser bundle bottom structure
20 seafloor
22 lower catenary flowlines
24 clump weight
26 BTM turret
28 lower riser mooring restraint
30 spring buoy
32 spring buoy mooring system
34 subsea buoy
36 vertical down pipe
38 horizontal connector pipe
40 lazy wave SCR
42 floatation
44 arched composite piping
46 riser bundle support shaft
48 riser connectors to turret piping
50 web
52 turret riser bundle support shaft
54 gimbal ring
56 gimbal pin to riser buoy
58 gimbal pin to turret
60 riser guide template
62 riser
64 riser hang-off pedestal
66 U-joint
68 riser trumpet
70 riser support deck
72 ballast compartment
74 riser trumpet
76 flowline catenary line
78 line or chains to clump weight
84 buoy to turret locators
86 turret buoy central shaft
88 turret to buoy connectors
90 riser hang-off pedestal
92 buoy riser deck
94 turret buoy
96 gimbal pin to buoy
98 riser bundle support shaft and buoy
100 spread-moored FPSO
102 template support tendon
104 intermediate template
106 bottom template structure
108 template cross-tie
110 fixed upper template A detailed description of one or more embodiments of the buoy and receptor as well as methods for its use are presented herein by way of exemplification and not limitation with reference to the Figures.

Referring now to FIG. 1, turret-moored FPSO 10 is rotatably coupled to turret 12 so as to permit FPSO 10 to weathervane about turret 12. Turret 12 is maintained in a substantially fixed position by mooring lines 14 which connect to anchoring means in seafloor 20.

Riser bundle 16 comprised of a plurality of flexible flow lines descends substantially vertically to the vicinity of seafloor 20. At the lower terminus of riser bundle 16 is riser bundle bottom structure 18 from which lower catenary flowlines 22 exit riser bundle 16 and connect to fluid conduits (not shown) on seafloor 20.

Riser bundle bottom structure 18 may hang freely from turret 12 of FPSO 10. In other embodiments, riser bundle bottom structure 18 may be equipped with restraint mooring lines which terminate in anchoring means in the seafloor to limit its horizontal excursions. In yet other embodiments, clump weight 24 may be connected to riser bundle bottom structure 18 to provide additional tension to riser bundle 16 thereby reducing its susceptibility to movement in currents and vortex-induced vibrations (VIV). Clump weight 24 may be used in conjunction with the optional restraint mooring lines.

Figure 1A:
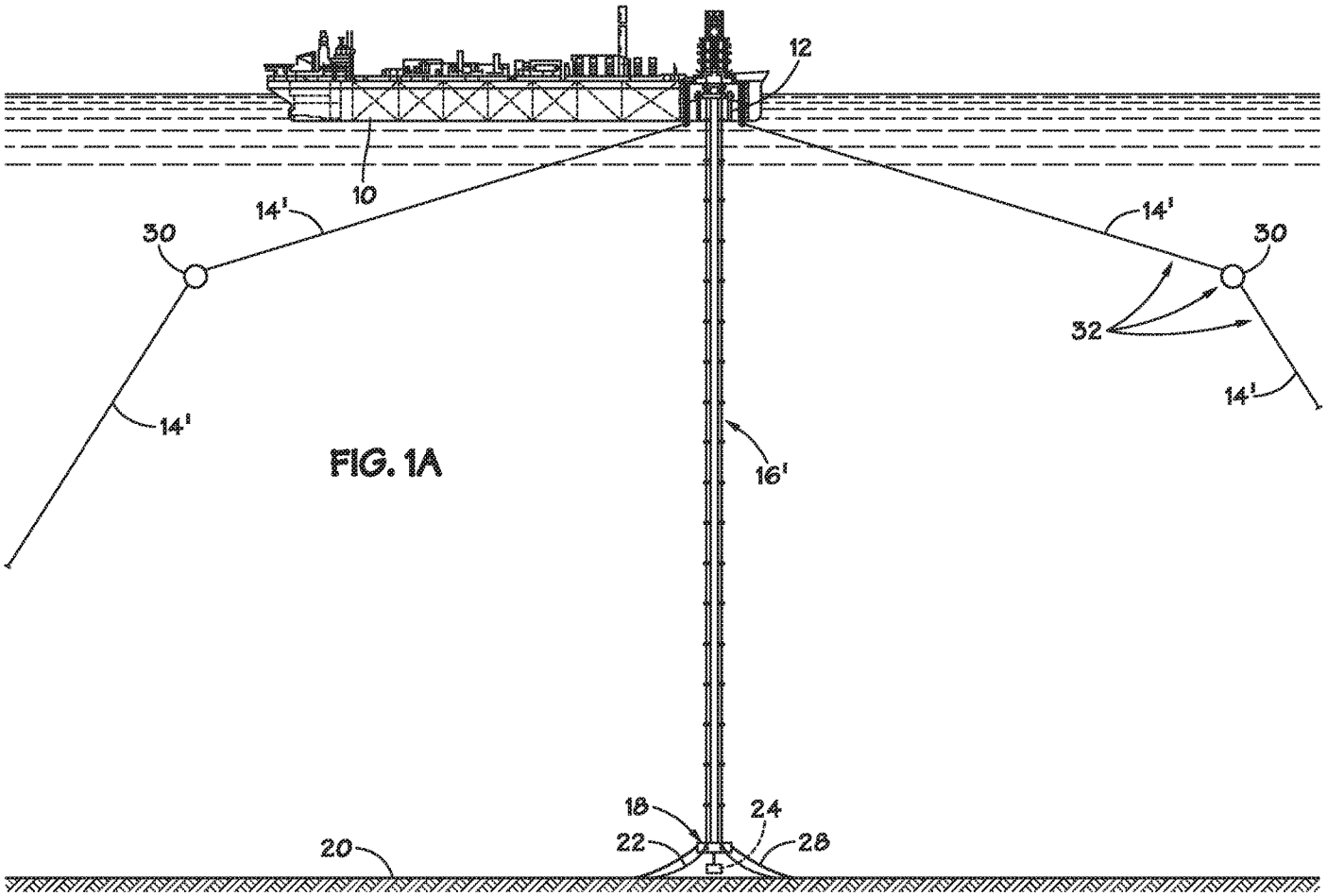
FIG. 1A is a schematic of a bundled flexible riser configuration for a turret moored FPSO system according to a second embodiment of the invention.
Figure 1B:
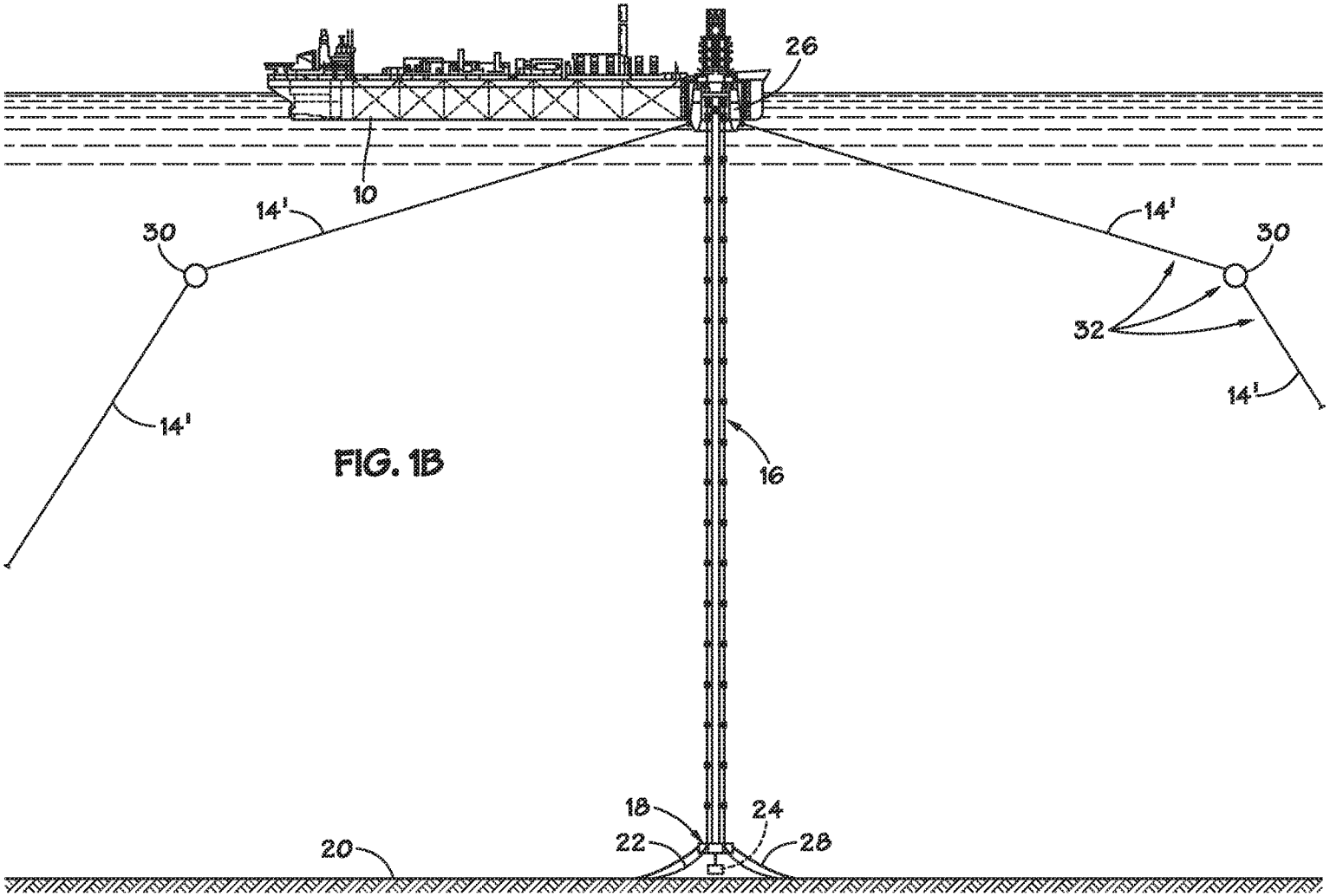
FIG. 1B is a schematic of a disconnectable bundled flexible riser configuration for a BTM turret moored FPSO system according to a third embodiment of the invention.
Figure 1C:
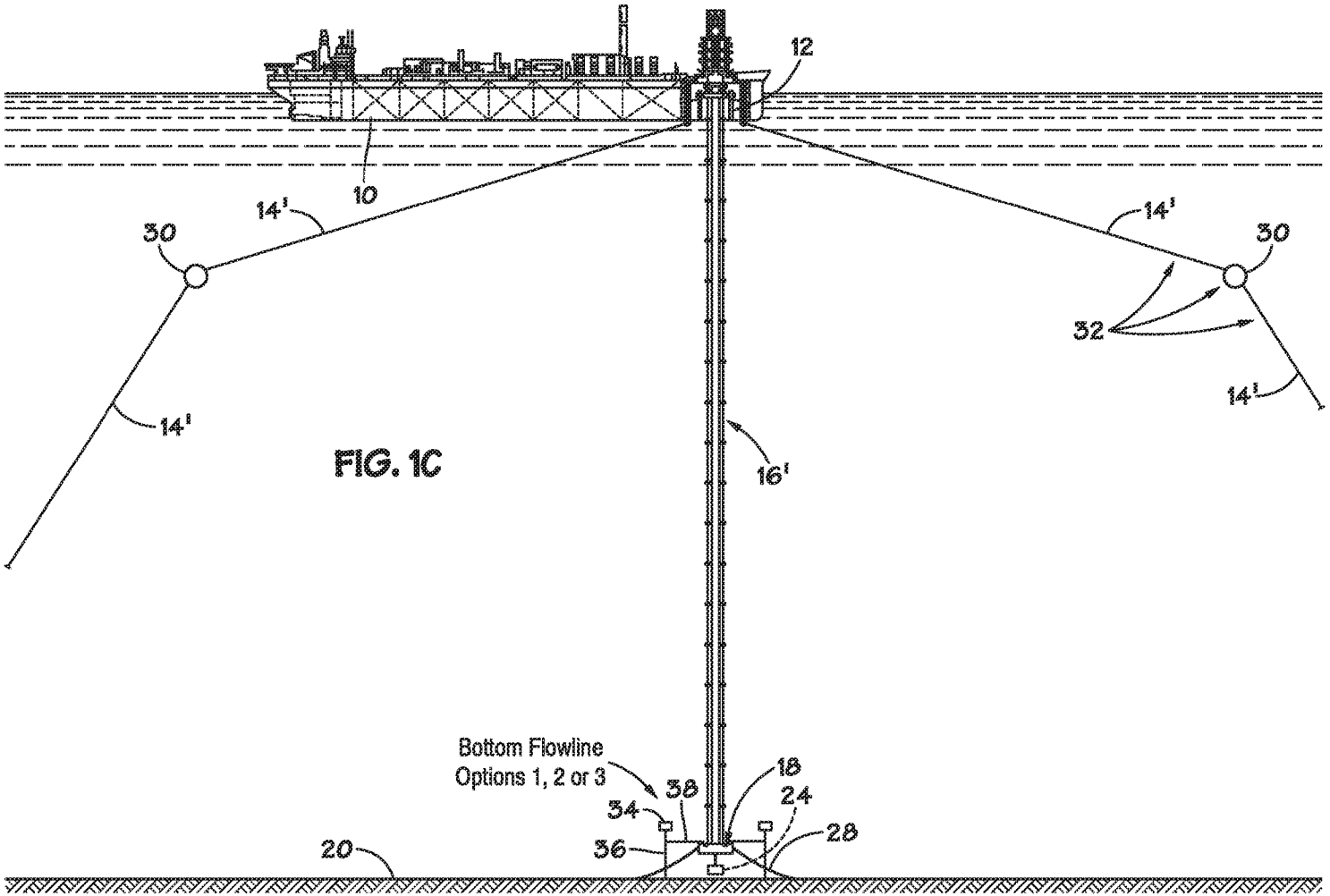
FIG. 1C is a schematic of a bundled flexible riser configuration for a turret moored FPSO system or a BTM turret moored FPSO system according to a fourth embodiment of the invention.
Figure 1D:
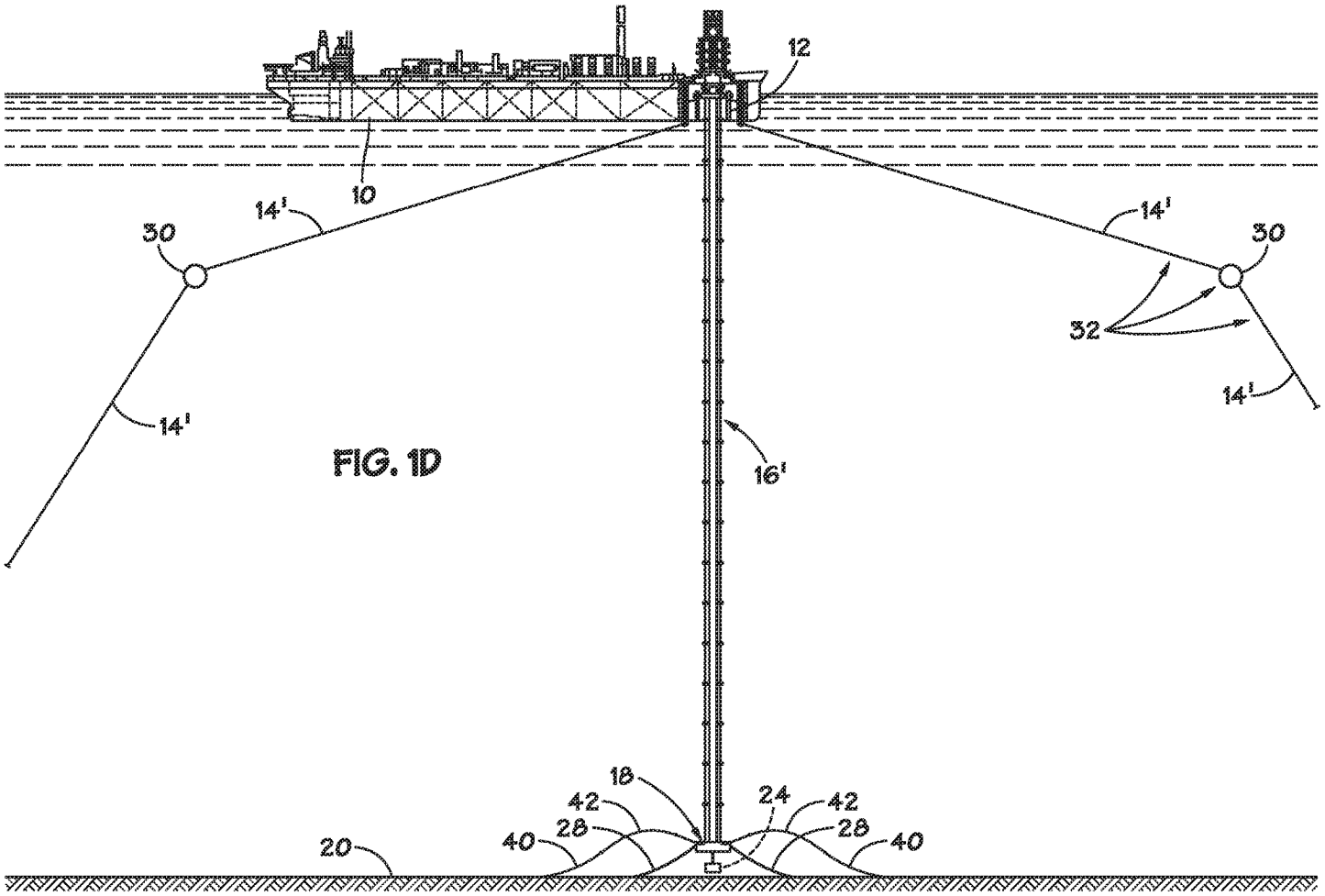
FIG. 1D is a schematic of a bundled flexible riser configuration for turret moored FPSO system or a BTM turret moored FPSO system according to a fifth embodiment of the invention.
Figure 1E:
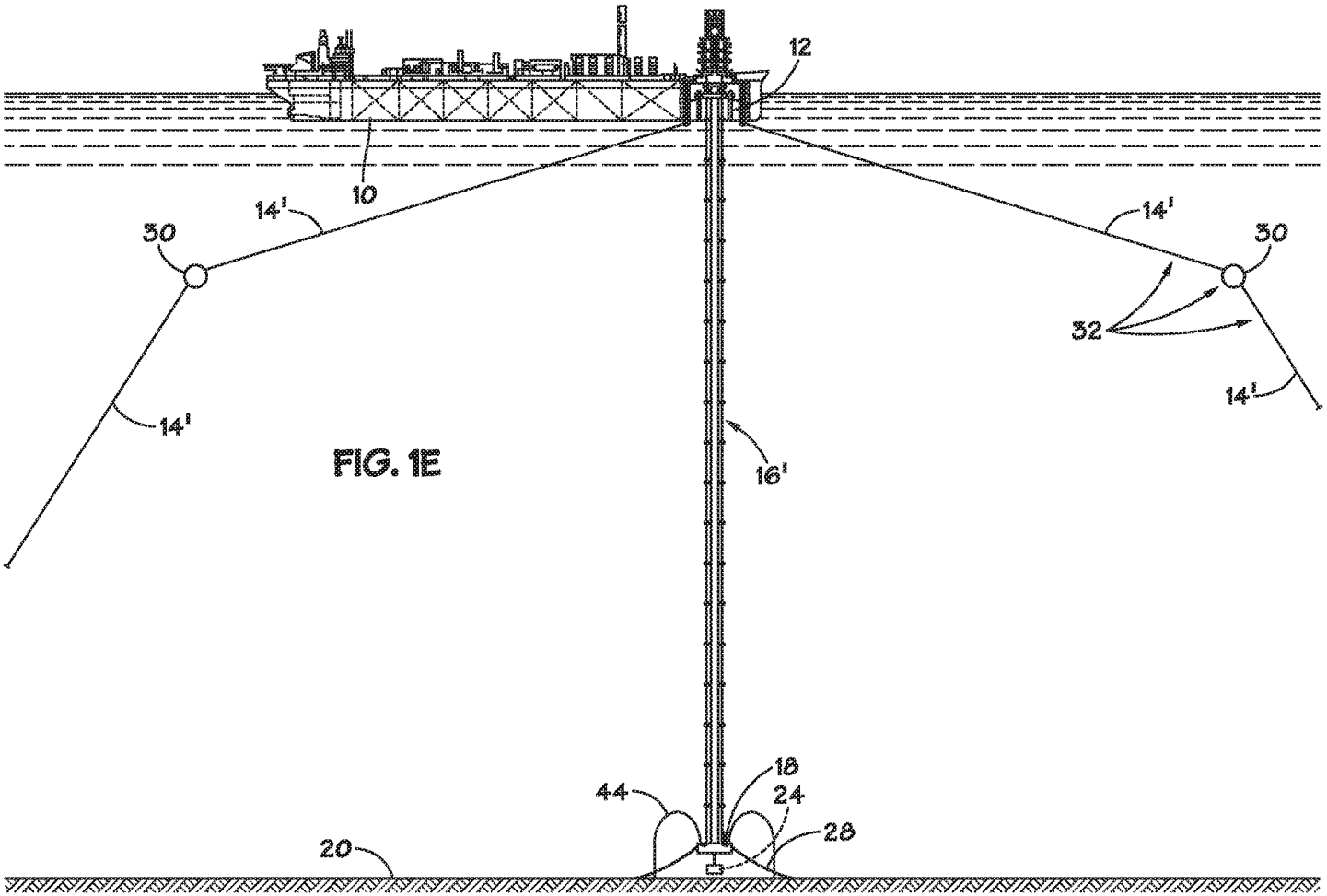
FIG. 1E is a schematic of a bundled flexible riser configuration for a turret-moored FPSO system or a BTM turret moored FPSO system according to a sixth embodiment of the invention.

FIG. 1A illustrates a turret-moored FPSO 10 having a deep water mooring system 32 that includes subsea spring buoys 30.

An alternative mooring system is illustrated in FIG. 1B. FPSO 10 is rotatably moored using a buoyant turret mooring (BTM) which comprises BTM turret 26 about which FPSO 10 may weathervane. In this embodiment, subsea spring buoys 30 are provided in mooring lines 14' to relieve at least a portion of the mooring line weight from FPSO vessel 10 and the BTM buoy.

FIG. 1C illustrates an embodiment of the invention wherein the fluid connections from the risers to equipment on seafloor 10 are made via substantially horizontal connector pipe 38 to vertical down pipe 36 which is supported by subsea buoy 34. Flexible connections at the ends of pipes 36 and 38 (not shown) allow for these pipes to provide continuous flow paths between sea bottom 20 and riser bottom structure 18.

FIG. 1D illustrates an embodiment of the invention that accommodates heave of FPSO 10 (and the motion of the bottom structure 18 to the seafloor 20) using steel catenary risers (SCRs) 40 in a lazy wave configuration. As is conventional in the art, the lazy wave configuration of SCRs 40 is produced by providing floatation 42 along a selected portion(s) of SCR 40. In this way, changes in the contact point of SCR 40 with seafloor 20 (which is known to cause wear in SCRs) is minimized. The connection of SCR 40 to the bottom structure 18 may include a Flex-joint which accommodates the relative angular motion between the riser and this structure.

Yet another embodiment of the invention is illustrated in FIG. 1E. In this embodiment, fluid connections from equipment on seafloor 20 to the risers in riser bundle 16 is made using composite piping in an arched configuration from seafloor 20 to bottom structure 18. Changes in the elevation of bottom structure 18 resulting from heave motions of FPSO 10 (and limited horizontal excursions of bottom structure 18) are accommodated by the arched configuration of the flexible composite piping. Relative angular motions at the ends of the flexible composite pipe may be controlled with bend restrictors that control the pipe curvature as it bends.

FIG. 2 illustrates an embodiment of the invention wherein risers 62 and riser bundle support shaft 46 are supported on gimbal ring 54 mounted on webs 50 within turret 12. Motion of risers 62 and riser bundle support shaft 46 in and out of the plane of the illustration is accommodated by gimbal ring 54 pivoting on gimbal pins 58. Motion of risers 62 and riser bundle support shaft 46 to the left or right in the plane of the illustration is accommodated by pivoting riser bundle support shaft 46 on gimbal pin to turret 12.

FIG. 2A illustrates an alternative embodiment wherein riser bundle support shaft 46 is suspended by universal joint (U-joint) 66 from riser support deck 70 within turret 12. Riser support deck 70 may be supported within turret 12 by structural web members 50. Riser bend guides ("trumpets") 68 may be provided on risers 62 above and/or below U-joint 66 to limit the bend radius of risers 62.

As will be appreciated by those skilled in the art, as riser bundle support shaft 46 swings on U-joint 66 the risers will slide axially relative to the riser bend guides 68 located below U-joint 66. To prevent or minimize wear which may occur as the result of this sliding motion, the outer surface of risers 62 in the vicinity of riser bend guides 68 and/or the inner surface of riser bend guides 68 may be provided with anti-friction material or coatings or mechanical devices such as rollers. For example, guide 68 may have its inner surface coated with Inconel and the riser may have a sequence of clamped-on, Teflon-impregnated, composite rings.

FIG. 3 illustrates the lower end of a bundled riser system for a turret-moored FPSO according to one embodiment of the invention. Riser bundle bottom structure 18 is equipped with ballast compartment 72 for providing tensioning weight to riser bundle support shaft 46. This ballast may be in lieu of or in addition to a clump weight suspended on chain 78. Riser bundle bottom structure 18 is also equipped with internal riser trumpets 74 for limiting the bend radius of risers 62 as they transition from a vertical segment which parallels riser bundle support shaft to a catenary portion which exits the lower surface of bottom structure 18. When the risers are suspended from a fixed upper support deck 70 as shown in FIG. 2A, the riser trumpets 74 may have wear-prevention means incorporated between them and the riser 62. In certain embodiments, bottom structure 18 may be equipped with restraints 28 which may comprise chain to anchoring means in the seafloor. In this way, horizontal excursions of bottom structure 18 may be limited.

FIG. 4A illustrates a embodiment of the invention having a disconnectable turret buoy 94 which is aligned by buoy-to-turret locators 84 so as to engage turret-to-buoy connectors 88 when turret buoy 94 is pulled into turret 12. Turret buoy 94 may have turret buoy central shaft 86 for buoy riser deck 92 which supports riser hang-off pedestals 90. In the illustrated system, U-joint 66 is used to suspend riser bundle support shaft 46 and trumpets 68 and 68' act to limit the bend radii of risers 62 when riser bundle support shaft and buoy 98 is not plumb. With this disconnectable buoy, the riser bundle support shaft and buoy 98 may be made partially buoyant to minimize the required buoyancy of turret buoy 94.

A gimbaled version of a disconnectable BTM supporting a riser bundle support shaft and buoy 98 is shown in FIG. 4B. In this embodiment, riser buoy 98 may be made positively buoyant by means of internal flotation material or captive air to help support turret buoy 94 in the disconnected state. Risers 62 and riser buoy 98 are supported with turret buoy central shaft 86 on gimbal ring 54 mounted on webs 50 within turret buoy 94. Motion of risers 62 and riser bundle support buoy 98 in and out of the plane of the illustration is accommodated by gimbal ring 54 pivoting on gimbal pins 96. Motion of risers 62 and riser buoy 98 to the left or right in the plane of the illustration is accommodated by pivoting riser buoy 98 on gimbal pin to riser buoy 56.

A riser system according to an embodiment of the invention designed for a spread moored FPSO 100 is shown in FIG. 5. In the illustrated preferred embodiment, the risers may be supported from above-water, riser support structures on the side of the vessel directly above a fixed template 110 attached to the vessel keel. The fixed template 110 has individual trumpet guides that limit the bending of risers 62 that occur due to vessel and riser motions as they pass through the template. An alternative riser support may have the risers directly attached to the fixed template 110 with bend restrictors around the risers (which may also be attached to template 110) to control the riser bending. Lower intermediate templates 104 are vertically spaced apart and are supported between a pair of template support tendons 102. Template cross-ties 108 may be used to interconnect templates on opposite sides of FPSO 100.

Template support tendons 102 extend to bottom template structure 106 which may be horizontally restrained by bottom restraint chains 28 which connect to anchoring means (not shown) in seafloor 20. The bottom template 106 may also include ballast material to tension the template support tendons 102 and thus stiffen the entire riser system. This will limit the excursions of the system to waves and currents.

At the lower terminus of each flexible riser 62 in bottom template 106, the riser 62 continues as a riser catenary 76 which provides fluid communication to equipment (not shown) on seafloor 20. Where the vertical riser 62 transitions to the catenary 76 in the bottom template, riser trumpets 74, as shown on FIG. 3, may be used to control the riser bending.

Figure 6B:
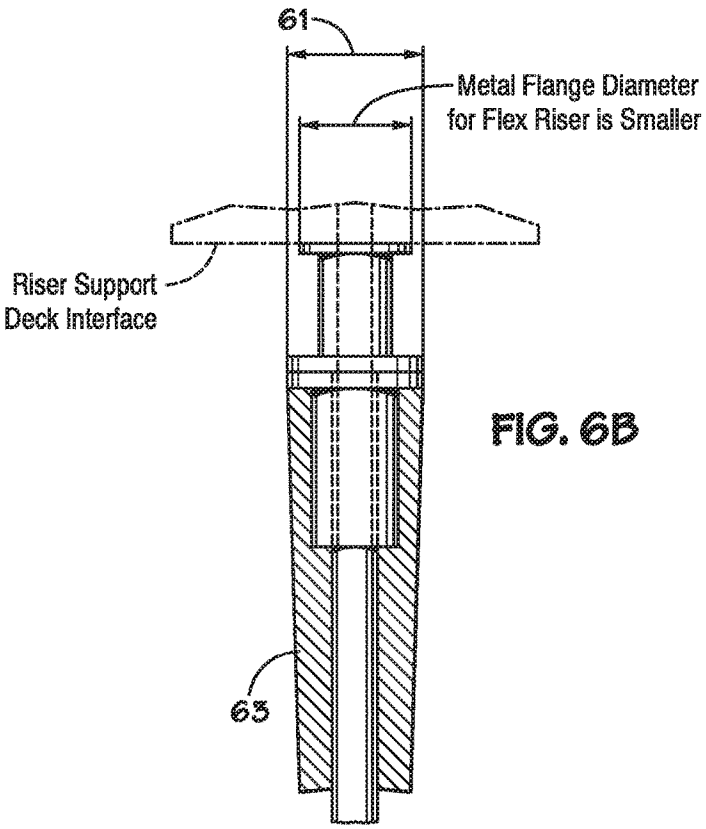
FIG. 6 is a schematic illustration of an alternative riser tie-off to a fixed FPSO riser deck.
Figure 6A:
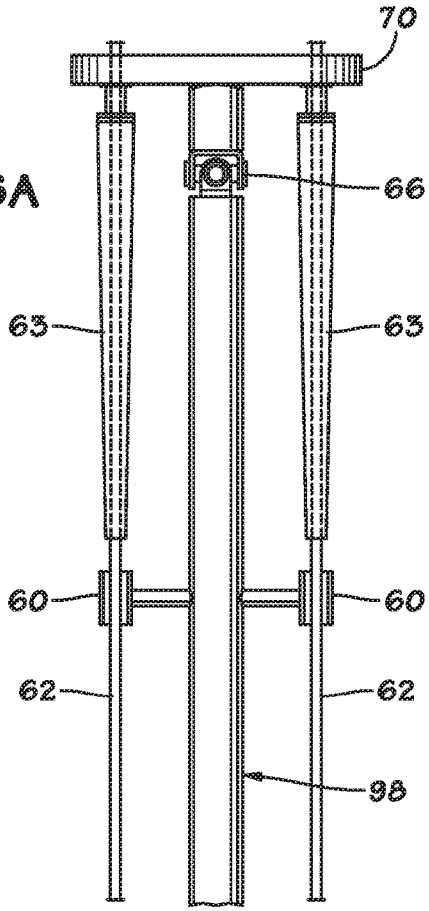
Figure 7D:
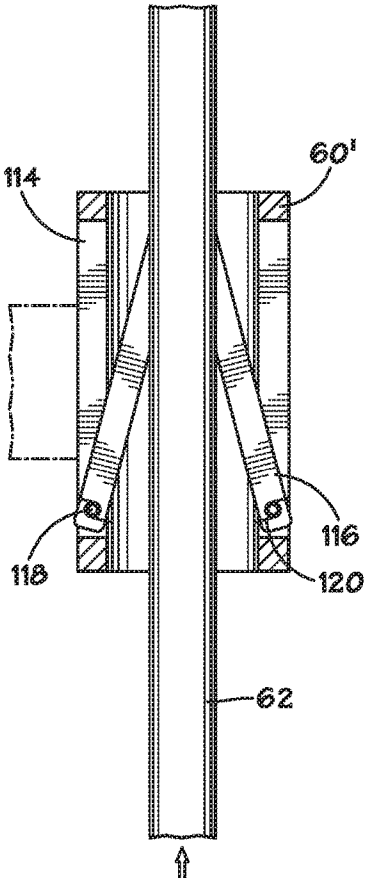
Figure 7C:
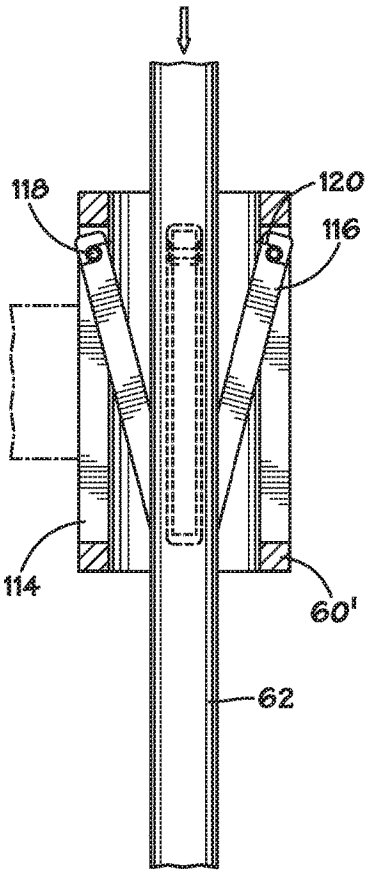
Figure 7B:
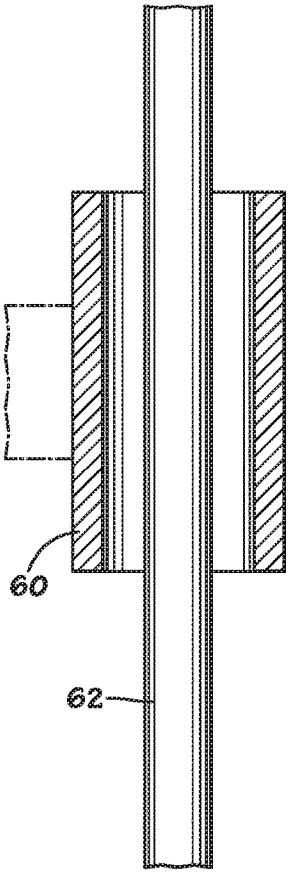
Figure 7A:
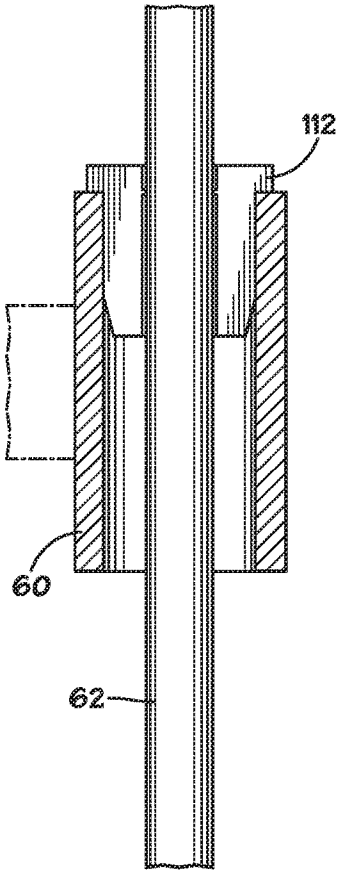

FIG. 6 illustrates a riser tie-off to a fixed FPSO riser deck that may be employed as an alternative to that shown in FIG. 2A. In place of U-joint riser bend guides 68, this embodiment has riser bend stiffeners 63 surrounding an upper portion of risers 62. Riser bend stiffeners 63 may act to limit the bend radius of the portion of risers 62 to which they are applied.

Riser bend stiffeners 63 may have particular application in the case of flex risers. The illustration on the right side of FIG. 6 shows an enlarged view of the upper portion of a flex riser equipped with a riser bend stiffener 63 according to the invention. As shown in this illustration, an adapter may be used to increase the diameter from that of the smaller metal flange diameter typically used for flex risers to that sufficiently wide to attach to the riser bend stiffener (i.e., riser bend stiffener flange diameter 61). In yet other embodiments, riser bend stiffeners 63 may be used in conjunction with U-joint riser bend guides 68.

FIG. 7 presents various exemplary riser guide template 60 sleeves. In the second-to-the-left embodiment, riser 62 is free to move laterally within riser guide template 60. In the leftmost illustration of FIG. 7, a split insert (that may be installed after riser installation by a diver or an ROV) restrains the lateral movement of riser 62 within riser guide template 60.

The two embodiments shown on the right side of FIG. 7 have three or more torsional-spring-loaded pins that act to push arms out of slots in the walls of the riser guide template 60 to center the riser 62 in riser guide template 60. The second-from-the-right illustration is a configuration that may be used when riser 62 is installed from the top in a downward direction. The rightmost illustration is that of an embodiment which may be used when riser 62 is installed from the bottom up.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A deep-water riser system comprising:

a floating member;

a riser bundle bottom structure;

a bundle of composite risers suspended from the floating member, each riser having an upper end attached to the floating member and an opposing lower end attached to the riser bundle bottom structure such that the bundle of composite risers is maintained under tension;

restraining elements configured to limit horizontal excursions of the risers in the bundle;

at least three, spring-loaded members within each restraining element that are configured to center the riser within a central bore of a restraining element, wherein the floating member is moored to the seabed with a plurality of first mooring lines such that horizontal excursions of the floating member are limited; and wherein the riser bundle bottom structure is moored above the seabed with a plurality of second mooring restraints such that horizontal excursions of the riser bundle bottom structure are limited.

2. The deep-water riser system recited in claim 1 wherein the spring-loaded members are configured to permit the insertion of a riser from an upper end of the retraining element.

3. The deep-water riser system recited in claim 1 wherein the spring-loaded members are configured to permit the insertion of a riser from a lower end of the retraining element.

4. The deep-water riser system recited in claim 1 further comprising a clump weight attached to the riser bundle bottom structure via a line.

5. The deep-water riser system recited in claim 4 wherein the length of the line is selected such that the clump weight is nominally suspended above the seafloor.

6. The deep-water riser system recited in claim 1 wherein the floating member is a turret-moored FPSO vessel.

7. The deep-water riser system recited in claim 1 wherein the floating member is a buoyant turret mooring buoy for an FPSO vessel.

8. The deep-water riser system recited in claim 1 wherein the floating member is a spread-moored FPSO vessel.

9. The deep-water riser system recited in claim 1 further comprising guides within the riser bundle bottom structure through which the composite risers pass said guides sized and configured to limit the bend radius of the composite risers.

10. A deep-water riser system comprising:

a floating member;

a riser bundle bottom structure;

a compartment within the riser bundle bottom structure sized and configured to contain variable ballast;

a bundle of composite risers suspended from the floating member, each riser having an upper end attached to the floating member and an opposing lower end attached to the riser bundle bottom structure such that the bundle of composite risers is maintained under tension;

wherein the floating member is moored to the seabed with a plurality of first mooring lines such that horizontal excursions of the floating member are limited; and wherein the riser bundle bottom structure is moored above the seabed with a plurality of second mooring restraints such that horizontal excursions of the riser bundle bottom structure are limited.

* * * * *